US006185782B1

(12) United States Patent
Hall

(10) Patent No.: US 6,185,782 B1
(45) Date of Patent: Feb. 13, 2001

(54) RAIN-GUTTER CLEANING SYSTEM

(76) Inventor: Ira George Hall, 17500 Skyline Blvd., Los Gatos, CA (US) 95030

( * ) Notice: Under 35 U.S.C. 154(b), the term of this patent shall be extended for 0 days.

(21) Appl. No.: 09/490,487

(22) Filed: Jan. 25, 2000

(51) Int. Cl.[7] ..... A47L 5/00
(52) U.S. Cl. ..... 15/339; 15/348; 15/383
(58) Field of Search ..... 15/339, 348, 383, 15/92, 23

(56) References Cited

U.S. PATENT DOCUMENTS

| | | | | |
|---|---|---|---|---|
| 3,638,369 | * | 2/1972 | Albrecht | 15/246 X |
| 3,751,749 | * | 8/1973 | Wilson | 15/92 |
| 4,168,559 | * | 9/1979 | Henson | 15/23 |
| 4,238,866 | * | 12/1980 | Taylor | 15/23 |
| 4,402,106 | | 9/1983 | Mattson | 15/406 |
| 4,602,460 | * | 7/1986 | Langenbach | 15/104.1 X |
| 4,718,613 | * | 1/1988 | Moomaw | 241/60 |
| 5,195,209 | | 3/1993 | Waltkin | 15/339 |

* cited by examiner

*Primary Examiner*—Chris K. Moore
(74) *Attorney, Agent, or Firm*—Robert Charles Hill

(57) ABSTRACT

A rain-gutter cleaning system has an agitator head that is mounted to the top end of a long suction tube and pole and supported aloft by them. A vacuum pump on the ground is connected to bring rain-gutter debris down the suction tube and into a collection bag. The agitator head includes rotating paddles that tear and break up tangles and clogs encountered in a rain gutter and has a rotating auger screw inside that helps direct the loosened debris down the throat of the suction tube. A camera mounted atop the agitator head allows an operator on the ground below to see the inside of the rain gutter on a small monitor screen.

7 Claims, 2 Drawing Sheets

RAIN-GUTTER CLEANING SYSTEM

BACKGROUND OF THE INVENTION

1. Field of the Invention

The present invention relates to rain-gutter cleaners, and more particularly to pole mounted devices that allow an operator to remain on the ground even when cleaning a second story rain gutter.

2. Description of Related Art

Rain gutters mounted on houses allow the run-off water to be directed away from people and buildings so it will do no harm. Tree leaves and other debris often clog and fill common rain gutters, and then the run-off from the roof will simply spill wherever it can.

The most direct way to clean out rain gutters is to go up on the roof and use a small scoop or hands to clean out the build-up. But working so close to the edge of a roof can be very dangerous. Working from ladders is a little better, but ladders are not completely safe either. Ladders are also awkward to move about and position, and some spots along the rain gutter cannot be reached by ladder.

A simple garden air blower was adapted to have a long snoot in U.S. Pat. No. 4,402,106, issued Sep. 6, 1983, to Charles A. Mattson. The end of the long snoot is hooked to blow down into a clogged rain gutter. However, such blower sprays debris all over, on the house, and even on the operator on the ground below. A badly matted or stubborn tangle of debris in the rain gutters can also prove an impossible challenge to such a simple blower technique. The operator also cannot see where the clogs are or what they consist of. So a lot of guesswork is involved in the operation of the device described by Mattson.

A better rain-gutter cleaning system is described by Richard L. Watkins in U.S. Pat. No. 5,195,209, issued Mar. 23, 1993. A camera is mounted on top of a long pole so the operator can see into the rain gutter being cleaned from a safe place on the ground. A long tube runs up the pole and is used to vacuum out the rain gutters. A gas engine carried on a backpack runs the portable vacuum cleaner. Even though the operator can now see into the rain gutters being cleaned, some tangles and build-ups tend to continually clog the intake.

SUMMARY OF THE INVENTION

An object of the present invention is to provide a gutter-cleaning system that is effective and able to clear out even the most stubborn clogs.

Another object of the present invention is to provide a rain-gutter cleaner that mechanically tears and conveys away debris it encounters.

Briefly, a rain-gutter cleaning system embodiment of the present invention has an agitator head that is mounted to the top end of a long suction tube and pole and supported aloft by them. A vacuum pump on the ground is connected to bring rain-gutter debris down the suction tube and into a collection bag. The agitator head includes rotating paddles that tear and break up tangles and clogs encountered in a rain gutter and has a rotating auger screw inside that helps direct the loosened debris down the throat of the suction tube. A camera mounted atop the agitator head allows an operator on the ground below to see the inside of the rain gutter on a small monitor screen. The camera can also record the cleaning process and document damaged or rotted gutters when connected to a camcorder.

An advantage of the present invention is that a rain-gutter cleaning system is provided that can clear stubborn clogs in rain gutters.

Another advantage of the present invention is that a rain-gutter cleaning system is provided that can be used by an operator on the ground.

A still further advantage of the present invention is that a rain-gutter cleaning system is provided that cleans without dirtying the house or the operator underneath.

The above and still further objects, features, and advantages of the present invention will become apparent upon consideration of the following detailed description of specific embodiments thereof, especially when taken in conjunction with the accompanying drawings.

DETAILED DESCRIPTION OF THE INVENTION

Figure 1:
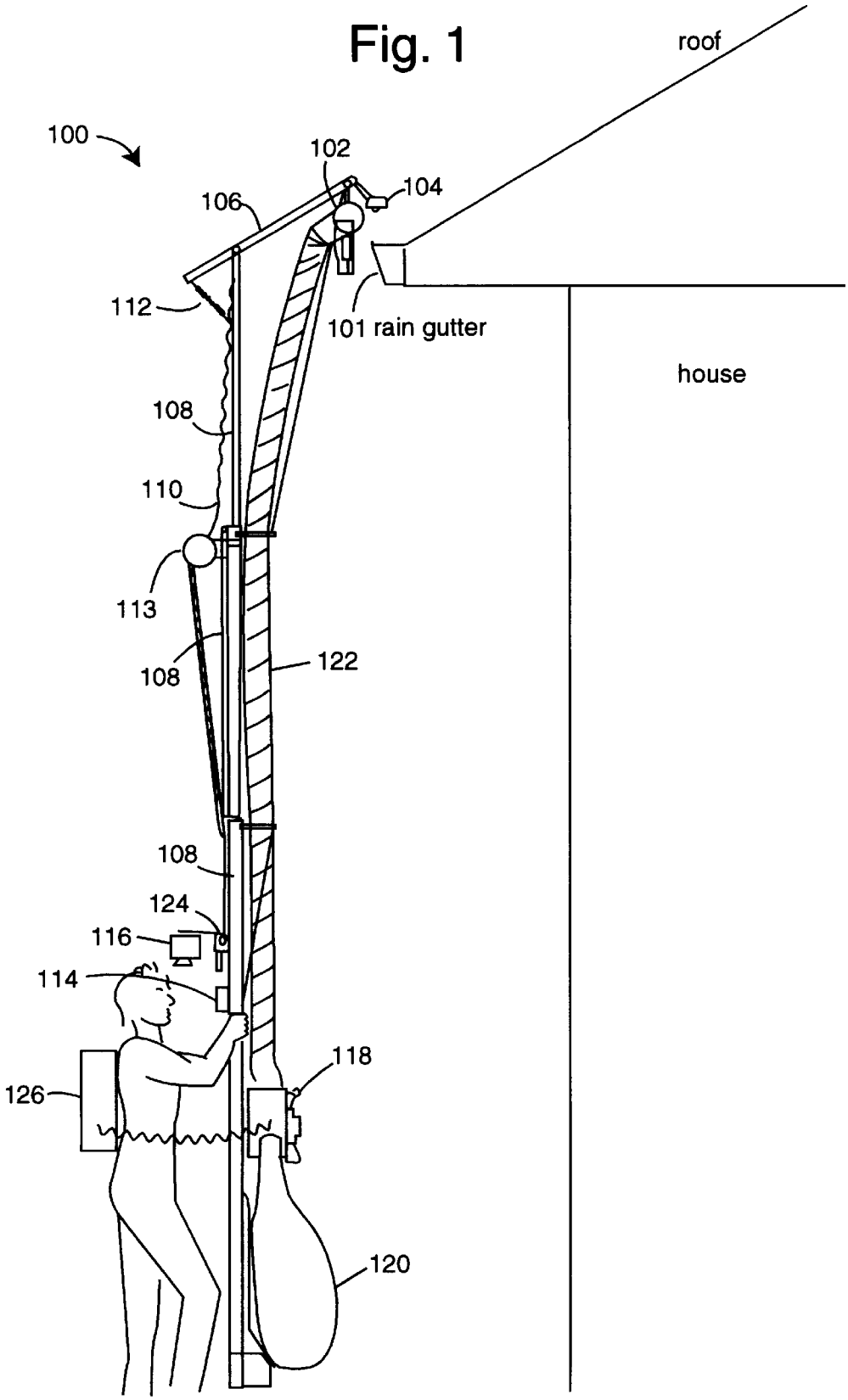
FIG. 1 is a diagram of a rain-gutter cleaning system embodiment of the present invention being used on a two-storey house by an operator.

FIG. 1 illustrates a rain-gutter cleaning system embodiment of the present invention referred to herein by the reference numeral 100. A rain gutter 101 that needs cleaning may be high on the eaves of a one or two story house. An agitator head 102 and video camera 104 are held aloft on a control boom 106. An extension pole 108 is fitted with a control cable 110 and a boom counter-balance spring 112. A wire-management spool 113 automatically takes up any slack in the control cable 110. A control panel 114 allows the operator to control activity within the agitator head 102. A display monitor screen 116 is connected to the video camera 104 and allows the operator to look into the rain gutter 101.

In alternative embodiments of the present invention, the display monitor screen 116 includes a video tape recorder, e.g., am 8 mm type, that allows the before and after condition of the rain gutter to be recorded. Such recording can be used to increase customer good will, or used in legal proceedings to prove or disprove liability.

A vacuum cleaner 118 has a collection bag 120 for loosened debris that flows down from the agitator head 102 through a suction hose 122. In alternative embodiments of the present invention, the extension pole 108 and suction hose 122 can be partly or totally replaced by lightweight rigid pipe sections.

An adjustment knob 124 is used to adjust the height of the extension pole 108 through a system of gears. The necessary operating power for the agitator head 102, video camera 104, display monitor screen 116, and vacuum cleaner 118, can be provided by a small gasoline-powered engine, battery, or electrical extension cord. Such power alternatives are represented by a back-pack power unit 126. Each different kind of power source has its own advantages and disadvantages. In alternative embodiments of the present invention vacuum 118, collection bag 120 and power unit 126 can be replaced by using flexible ducting that connects to a remote vacuum that may be portable or truck mounted.

Embodiments of the present invention are portable and such that operators are able to clean rain gutters while standing on the ground. A gas engine or other power unit is typically mounted in a back pack, much like the portable blowers so popular with the commercial maintenance companies. The engine powers a vacuum system, attached to which is an expandable suction tube capable of reaching the rain gutters on a one and two story house while the operator is standing on the ground. It is conceivable that this mechanism may be capable of reaching even higher than two stories, but a prototype that was built extended no more than twenty feet.

The top head has a U-shaped adaptor tube that transitions from a round expandable to the flat bottomed and straight sided configuration of most gutters. The opening of such adaptor tube is fitted with a small electric or vacuum powered motor fitted with a paddle wheel or rotating string embodiment of the present invention similar in appearance to that of a weed eater, except smaller. This is used to break up any matted leaves and other debris in the gutter to make the vacuuming go quicker and more efficiently It also aids in preventing clogging of material in the vacuum tube. A mirror, series of mirrors, and/or fiber optic can alternatively be installed on the vacuum tube to allow the operator to see inside the gutter being cleaned. Such fiber optic may be connected to an ordinary camcorder with a view finder that the operator can look at as he is walking along under the gutter. This would also allow the operator to video record the condition of the inside of the gutters. The power plant for the vacuum may either be gas or electric powered, and is preferably an off-the-shelf item supplied on the commercial market.

Figure 2:
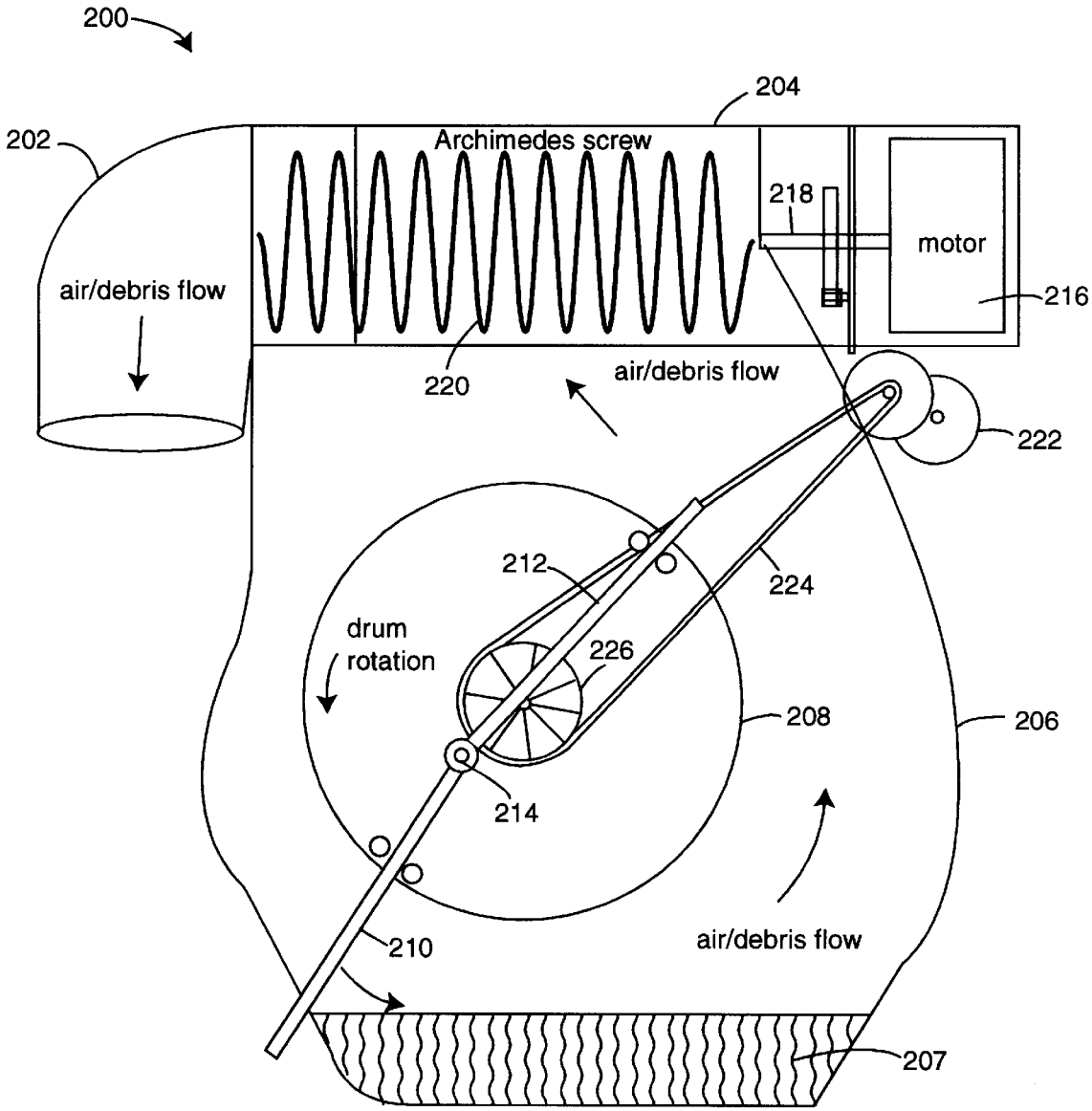
FIG. 2 is a cross sectional diagram of an agitator head for a rain-gutter cleaning system like that shown in FIG. 1.

FIG. 2 illustrates an agitator head 200 that is similar to that shown in FIG. 1. Such agitator head 200 acts as a vacuum cleaner nozzle with a beater that rotates inside. The agitator head 200 includes a suction elbow 202 that connects to a top end of a flexible vacuum hose, e.g., hose 122 (FIG. 1). A top housing 204 directs loosened rain-gutter debris received from a vacuum plenum 206 to the suction elbow 202 and then down the flexible vacuum hose. A fringe 207 made of brush hairs or a soft flexible membrane helps to seal the vacuum plenum 206 to the insides and bottom of a rain gutter being cleaned during use. A rotating drum 208 inside the vacuum plenum 206 carries a pair of paddles 210 and 212. A crank axle 214 causes the paddles to extend out further at the bottom part of their swing, e.g., paddle 210 is shown extended and paddle 212 is shown retracted into the drum 208. The bottom of the vacuum plenum 206 is open and the paddles 210 and 212 swing rapidly through in a beating action that is intended to gouge, rip, tear, and otherwise loosen an swing up debris that was clogging a rain gutter. In some situations, the vacuum alone may be enough to clear the debris.

A motor 216 drives an axle shaft 218 and rotates an auger screw 220. In one direction of rotation, the auger screw 220 conveys loosened debris pulled up inside the vacuum plenum 206 to the suction elbow 202 and down the flexible vacuum hose. In another direction of rotation, a jam caused by too much debris can be cleared. The controls 114 (FIG. 1) can be used to switch the direction of rotation of the motor 216.

A second completely independent motor, or motor 216 is connected to a system of reduction gears and chain sprockets 222. A drive chain 224 connects these to a sprocket 226 that turns the drum 208. The motors used are preferably electric types that operate on twelve volts direct current (12 VDC). However, other voltages and kinds of motors can be used, e.g., hydraulic, vacuum, or pneumatic motors.

Although particular embodiments of the present invention have been described and illustrated, such is not intended to limit the invention. Modifications and changes will no doubt become apparent to those skilled in the art, and it is intended that the invention only be limited by the scope of the appended claims.

What is claimed is:

1. An improved rain-gutter cleaning system with a vacuum cleaner connected through a vacuum hose to a rain-gutter cleaning nozzle, the improvement comprising:

an agitator head connected at a top end of said vacuum hose;

an auger screw disposed within the agitator head and providing a mechanical conveying means to collect loose debris in a rain gutter into a throat at a top end of said vacuum hose; and a beater paddle disposed within the agitator head and providing a mechanical means to break loose debris in said rain gutter and to sling it up into the auger screw.

2. The improved rain-gutter cleaning system of claim 1, further comprising:

a motor disposed within the agitator head and connected to simultaneously drive the auger screw and the beater paddle.

3. The improved rain-gutter cleaning system of claim 2, further comprising:

a power source located at ground-level that is connected to power the motor in forward and reverse directions.

4. The improved rain-gutter cleaning system of claim 1, further comprising:

a first electrical motor disposed within the agitator head and connected to drive the auger screw; and a second electrical motor disposed within the agitator head and connected to drive the beater paddle.

5. The improved rain-gutter cleaning system of claim 1, further comprising:

a pole on top of which is mounted the agitator head and allowing a user to remain on the ground while guiding the agitator head along an inside channel of a clogged rain gutter at the edges of a roof of a building;

a camera system mounted to the pole such that a user on the ground may see into a rain gutter being cleaned.

6. The improved rain-gutter cleaning system of claim 1, further comprising:

a pole on top of which is mounted the agitator head and allowing a user to remain on the ground while guiding the agitator head along an inside channel of a clogged rain gutter at the edges of a roof of a building; and a video system mounted to the pole and such that a video recording may be made of said inside channel before, during, or after cleaning.

7. An improved rain-gutter cleaning system with a vacuum cleaner connected through a vacuum hose to a rain-gutter cleaning nozzle, the improvement comprising:

an agitator head connected at a top end of said vacuum hose;

an auger screw disposed within the agitator head and providing a mechanical conveying means to collect loose debris in a rain gutter into a throat at a top end of said vacuum hose;

a beater paddle disposed within the agitator head and providing a mechanical means to break loose debris in said rain gutter and to sling it up into the auger screw;

a motor disposed within the agitator head and connected to drive at least one of the auger screw and the beater paddle; and a pole on top of which is mounted the agitator head and allowing a user to remain on the ground while guiding the agitator head along an inside channel of a clogged rain gutter at the edges of a roof of a building.

* * * * *